US007125024B1

(12) United States Patent
Kelly

(10) Patent No.: US 7,125,024 B1
(45) Date of Patent: Oct. 24, 2006

(54) QUICK-RELEASE AXLE ASSEMBLY FOR IN-LINE SKATE

(76) Inventor: Keith B. Kelly, 3214 Woodridge Dr., Pittsburgh, PA (US) 15227

( * ) Notice: Subject to any disclaimer, the term of this patent is extended or adjusted under 35 U.S.C. 154(b) by 292 days.

(21) Appl. No.: 10/830,840

(22) Filed: Apr. 23, 2004

Related U.S. Application Data

(60) Provisional application No. 60/465,033, filed on Apr. 25, 2003.

(51) Int. Cl.
*A63C 17/00* (2006.01)

(52) U.S. Cl. ..... 280/11.27

(58) Field of Classification Search ..... 280/11.19, 280/11.221, 11.223, 11.27, 842; 301/5.301, 301/5.305, 5.306; 403/349, 361
See application file for complete search history.

(56) References Cited

U.S. PATENT DOCUMENTS

| | | | | |
|---|---|---|---|---|
| 1,217,761 | A * | 2/1917 | Hartman | 280/11.223 |
| 1,818,261 | A * | 8/1931 | Koch et al. | 403/341 |
| 5,271,633 | A | 12/1993 | Hill, Jr. | 280/11.22 |
| 5,356,209 | A * | 10/1994 | Hill | 301/5.7 |
| 5,601,342 | A | 2/1997 | Perner | 301/5.3 |
| 5,630,652 | A | 5/1997 | Cech | 301/5.3 |
| 5,749,592 | A * | 5/1998 | Marchetto | 280/292 |
| 5,769,432 | A * | 6/1998 | Tybinkowski et al. | 280/11.204 |
| 5,800,022 | A | 9/1998 | Del Rosario | 301/5.3 |
| 5,891,115 | A | 4/1999 | Hauer et al. | 301/111 |
| 5,941,539 | A * | 8/1999 | Pratt | 280/11.27 |
| 5,961,132 | A | 10/1999 | Post | 280/11.22 |
| 5,964,537 | A | 10/1999 | Hill, Jr. | 384/559 |
| D424,150 | S | 5/2000 | Post | D21/771 |
| 6,607,198 | B1 * | 8/2003 | Szendel | 280/11.27 |

* cited by examiner

*Primary Examiner*—Frank Vanaman
(74) *Attorney, Agent, or Firm*—Armstrong, Kratz, Quintos, Hanson & Brooks, LLP

(57) ABSTRACT

An axle assembly for an in-line skate for retaining a wheel and a pair of bearings in a chassis of the in-line skate. The axle assembly has an elongated spacer hub, for supporting a bearing at each end portion thereof; an elongated male coupler, for bearing on a first side wall of the in-line skate chassis; and an elongated female coupler, for bearing on an opposing second side wall of the in-line skate chassis. The male and female couplers are insertable inwardly through axle bores of the chassis then through opposite ends of the spacer hub to obtain an assembled condition in which the wheel and pair of bearings are retained in the chassis. The male and female couplers are provided with means for interlocking with each other when in the assembled condition, to prevent outwardly movement of the couplers.

8 Claims, 9 Drawing Sheets

QUICK-RELEASE AXLE ASSEMBLY FOR IN-LINE SKATE

This application claims the benefit of U.S. Provisional Application No. 60/465,033, filed Apr. 25, 2003.

FIELD OF THE INVENTION

The present invention relates to in-line skates. In particular, it relates to an axle assembly for in-line skates to facilitate replacement of bearings and wheels of the skates.

BACKGROUND OF THE INVENTION

In-line skating is a popular activity enjoyed by many, both young and old. It is preferred by many as a means for exercising, as it is less demanding of knees and other parts of the body than running or jogging. In-line skating is also done competitively by in-line skating enthusiasts.

A plurality of wheels on an in-line skate are typically supported on a chassis of the skate through a pair of bearings disposed at each end of an axle. Various skating surfaces on which skating is carried out, for example asphalt and concrete, can cause rapid wear to contact surfaces of the wheels, which are typically formed of a polymer material. Also, debris found on skating surfaces, such as sand, cinders, slag, or the like can enter the bearings and cause rapid wear of the balls, rollers, or races of the bearings. Therefore, it is advantageous when using in-line skates to have available spare wheels and bearings for replacement, in the event a wheel or bearing becomes worn and unusable.

For convenience or to save time, especially when in competition, it is preferred to have an axle assembly which can be quickly disassembled and reassembled. Also, it is preferred to be able to disassemble and assemble the axle assembly without the use of tools such as wrenches, pliers, screw drivers, or the like.

Another consideration in an axle assembly is the amount of extension of any axle retaining component beyond the end of the axle, as often, especially in competition, when leaning into a curve the skates are at an angle which places ends of the axles close to the skating surface. An axle assembly having a bulky retaining component or retaining component extending too far beyond the chassis of the skate, could cause a fall if contact is made with the skating surface.

Examples of axle assemblies, as just described, are found in U.S. Pat. No. 5,601,342 and U.S. Pat. No. 5,630,652 wherein an axle extends beyond a chassis of the skate and a bulky bolt lever or actuator/cap is used to retain the axle.

Another axle assembly, such as that found in U.S. Pat. No. 5,271,633, requires the use of a screw driver in order to disassemble the axle assembly, and a good locking means is not provided to keep the axle assembly from disconnecting during use of the skates.

The axle assembly found in U.S. Pat. No. 5,891,115 requires the use of an allen wrench in a drive recess of the axle, in order to assemble the axle assembly.

OBJECTS OF THE INVENTION

It is an object of the present invention to provide a durable axle assembly for an in-line skate which reliably retains a wheel and bearings in a chassis of an in-line skate.

It is another object of the present invention to provide an axle assembly which can be disassembled and assembled without the use of hand tools.

It is still another object of the present invention to provide an axle assembly which does not extend beyond the chassis of the skate an amount that would prevent the skater from inclining the skate to the skating surface as may be done when rounding a curve.

It is still another object of the invention to provide an axle assembly which is easily useable and with components configured so as to prevent mis-assembly of the axle assembly.

SUMMARY OF THE INVENTION

The present invention is an axle assembly for an in-line skate, for retaining a wheel and a pair of bearings in a chassis of the in-line skate. The axle assembly has an elongated spacer hub, for supporting a bearing at each end portion thereof. The axle assembly also has a male coupler, for bearing on a first side wall of the in-line skate chassis, and a female coupler, for bearing on an opposing second side wall of the in-line skate chassis. The male and female couplers are insertable inwardly through axle bores of the chassis then into opposite ends of the spacer hub to be in an assembled condition in which the wheels and the pair of bearings are retained in the chassis. Each coupler is provided with means for engaging each other, when the couplers are in the assembled condition, so as to prevent outwardly movement of the couplers.

BRIEF DESCRIPTION OF THE DRAWINGS

The invention will become more readily apparent from the following description of a preferred embodiment thereof shown, by way of example only, in the accompanying drawings, wherein.

DETAILED DESCRIPTION OF THE INVENTION

The present invention is an axle assembly which could be used by an original equipment manufacturer on new in-line skates, or by owners of in-line skates that wish to improve the performance of their skates by substituting axle assemblies of the present invention for original axle assemblies. The axle assembly of the present invention is configured so as to be useable in most brands of in-line skates.

Figure 1:
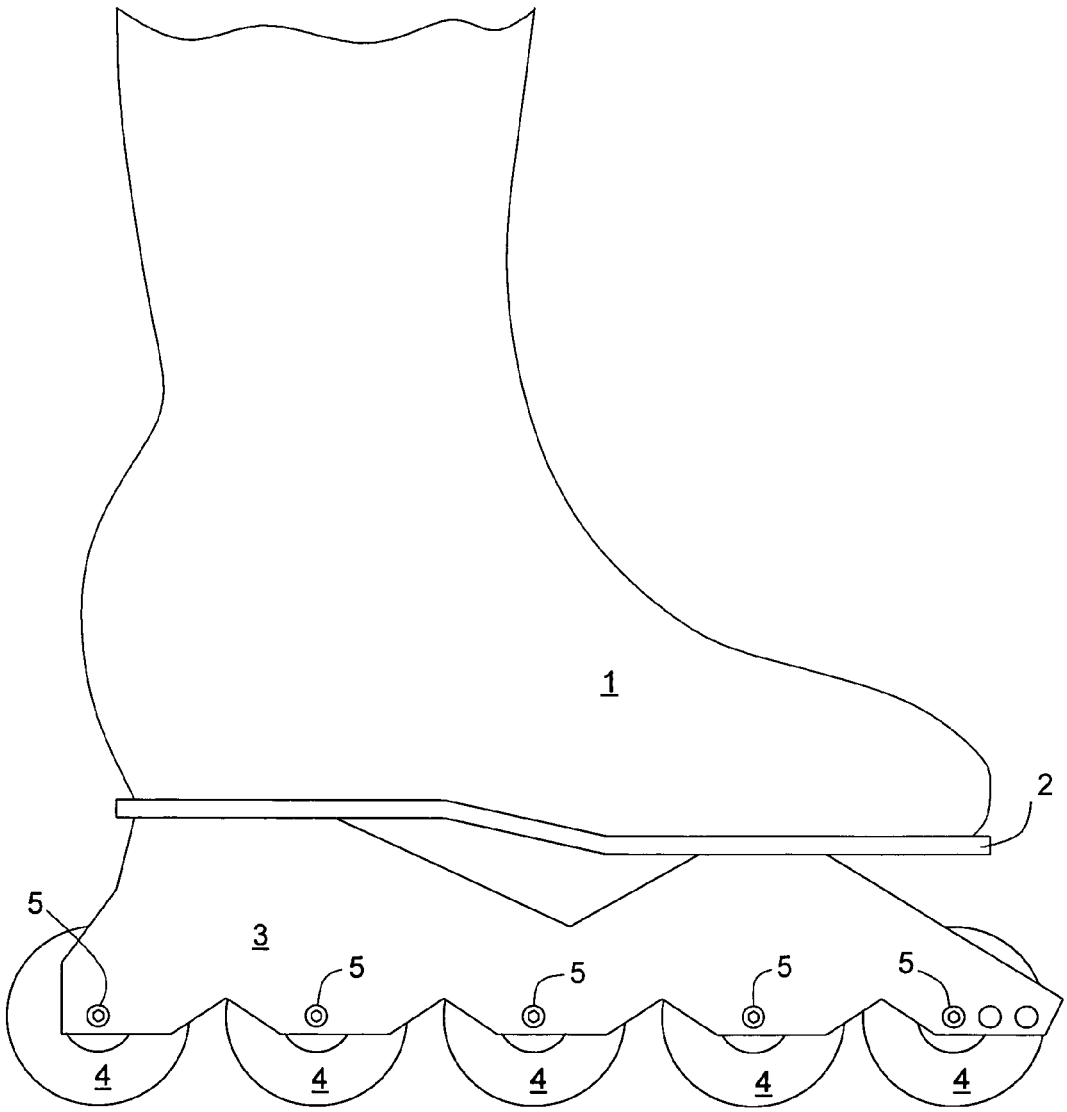
FIG. 1 PRIOR ART
FIG. 1 is a side view of a prior art in-line skate.
Figure 2:
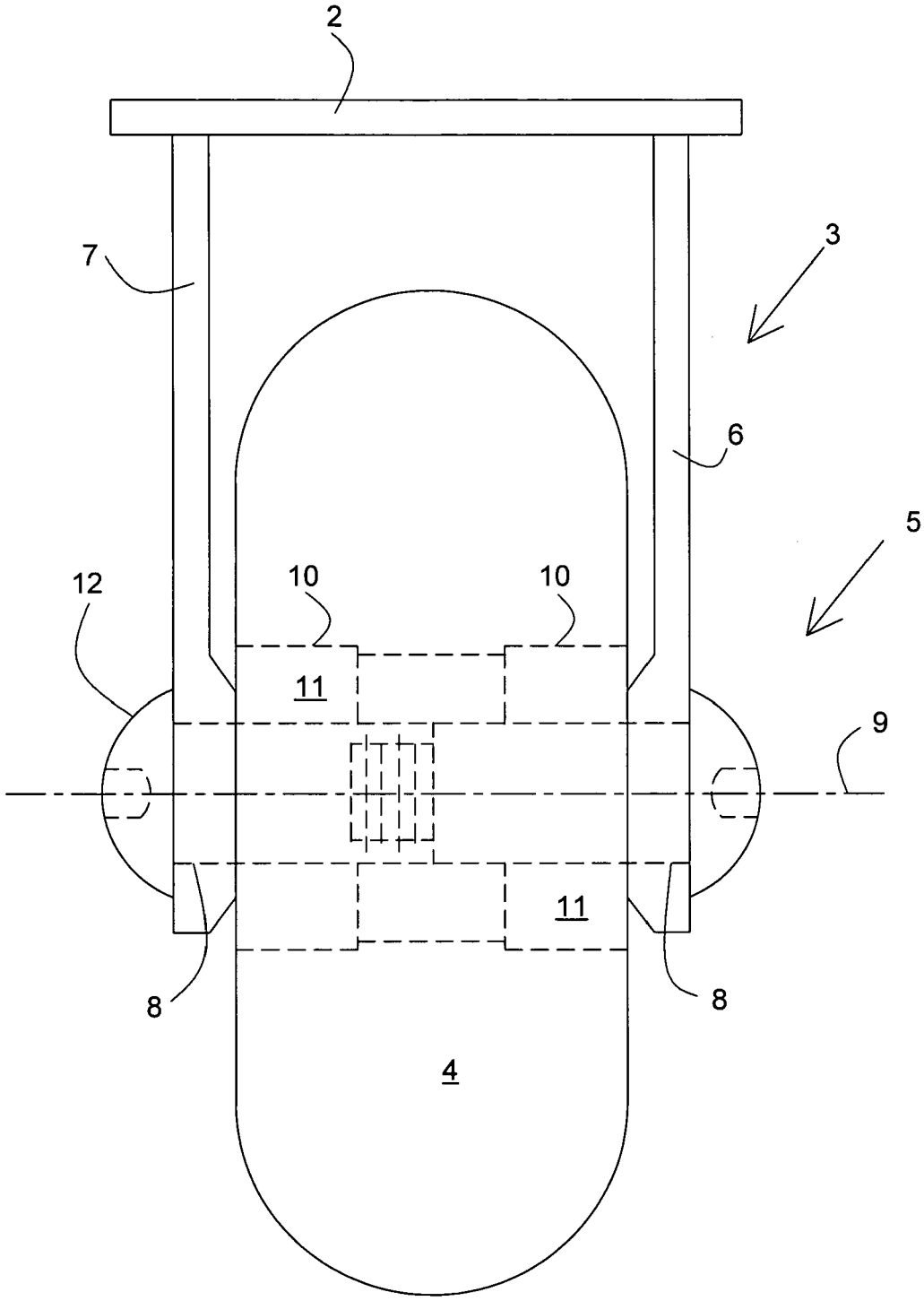
FIG. 2 PRIOR ART
FIG. 2 is an end view of a portion of the prior art in-line skate of FIG. 1.

FIGS. 1 and 2 show a side and an end view respectively of conventional in-line skates, having known axle assemblies requiring an allen wrench for disassembling and assembling. The axial assembly of the present invention is configured for use on an in-line skate of this type.

In FIG. 1, a skate boot 1, including a sole portion 2, is attached to an in-line skate chassis 3 having a plurality of wheels 4. Each wheel is attached to the chassis with use of an axle assembly 5. The arrangement of a wheel 4 and axle assembly 5 on chassis 3 is better viewed in FIG. 2. Referring to FIG. 2, chassis 3 includes opposing sidewalls 6 and 7 projecting vertically downward from the body of the chassis. Each sidewall has an axle bore 8 arranged so that the bores of the two sidewalls are in alignment with a central axis 9.

Each wheel, which is typically molded of a polymer material, has bearing cavities 10 molded therein, at both sides of the wheel 4, which are centered, when assembled, on central axis 9. Bearings 11 are inserted in the cavities 10 so as to enable nearly frictionless rotation of the wheels on the skate chassis.

In mounting the wheels to an in-line skate, as shown in FIG. 2, each wheel and pair of bearings is first assembled and then slid into the gap between the side walls 6 and 7 of the chassis 3, so as to align the centers of the bearings with the centers of the axle bores. Then, each portion of the axle assembly 5 is inserted through one of the sidewalls (6, 7) and one of the pair of bearings 11. The axle is secured in that arrangement by using allen wrenches to thread an external thread of one portion into an internal thread of the other portion. The prior in-line skate of FIGS. 1 and 2 is only one example of many axle assemblies which are available. However, the chassis, arranged with the opposing sidewalls and axle bores, are found on many brands of in-line skates.

As discussed above, the present axle assembly is configured to replace most axle assemblies as known and described in FIG. 2, without the need for modification to the chassis 3, wheel 4 or bearings 11.

Figure 3:
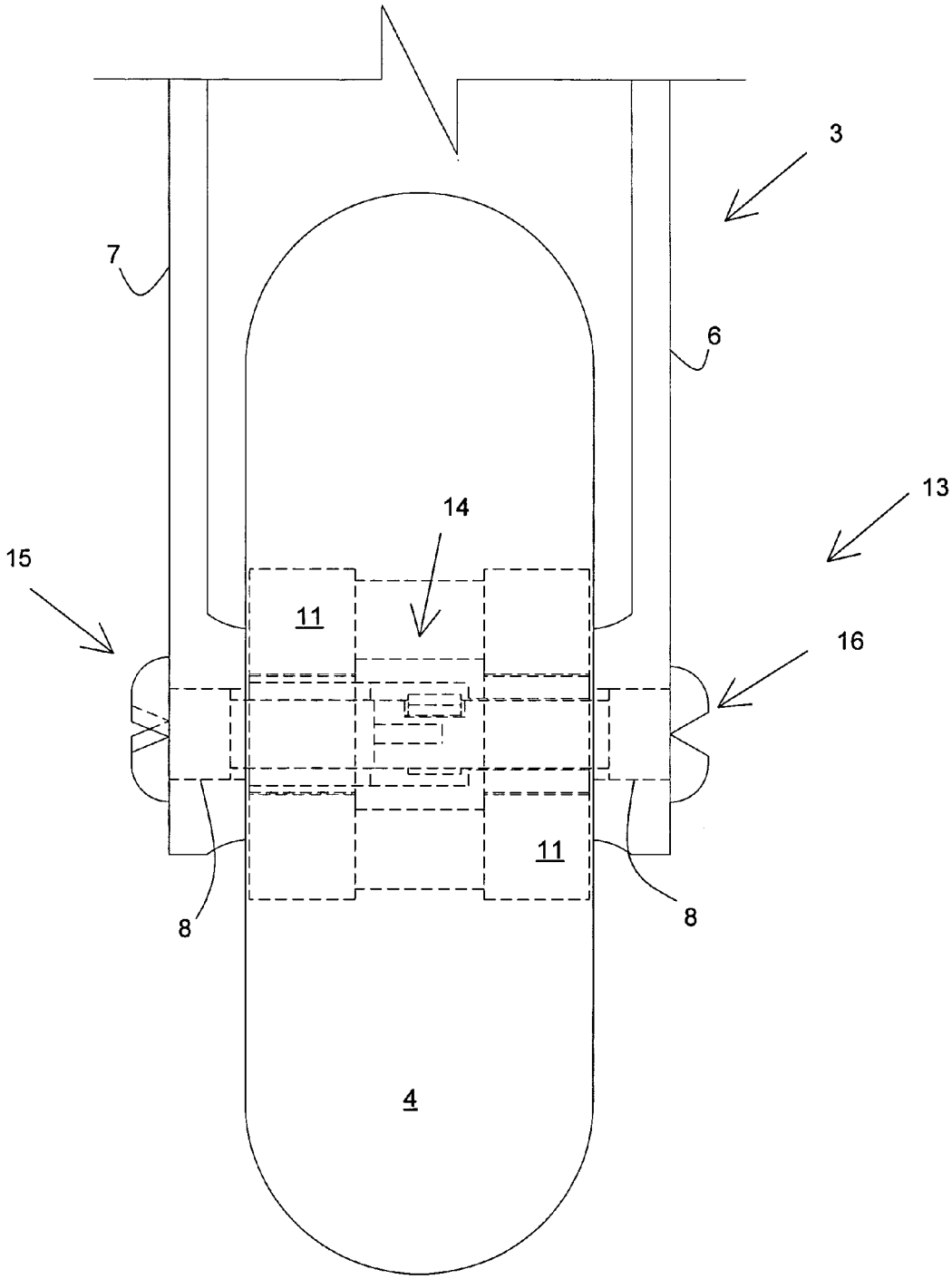
FIG. 3 is an end view of an in-line skate having an axle assembly of the present invention.

FIG. 3 shows an axle assembly 13 of the present invention in place on a conventional in-line skate. In FIG. 3, wheel 4 having bearings 11, is mounted to chassis 3 having sidewalls 6 and 7 with axle bores 8. In the present invention, axle assembly 13, is made up of a spacer hub 14, a male coupler 15, and a female coupler 16, which, when assembled, reliably holds the wheel 4 and bearings 11 in place on chassis 3. Details of each of the components, spacer hub 14 and couplers 15, 16 are shown in detail in FIGS. 4 *a–e*, 5 *a–d*, and 6 *a–d*, and described below.

Figure 4B:
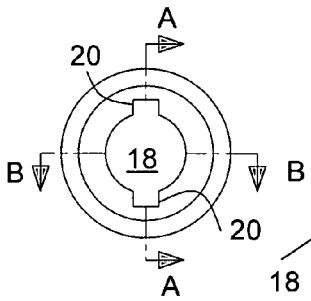
FIGS. 4*a–e* are a side view, end views, and sectional views of a spacer hub of the present invention.
Figure 4A:
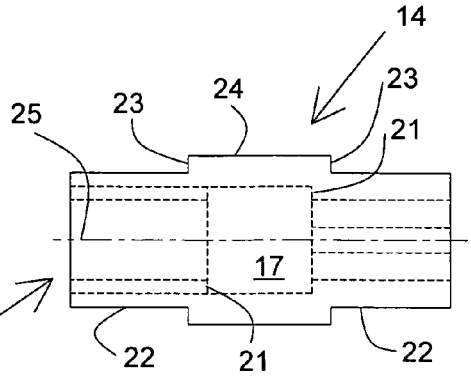
Figure 4C:
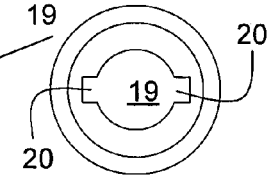
Figure 4D:
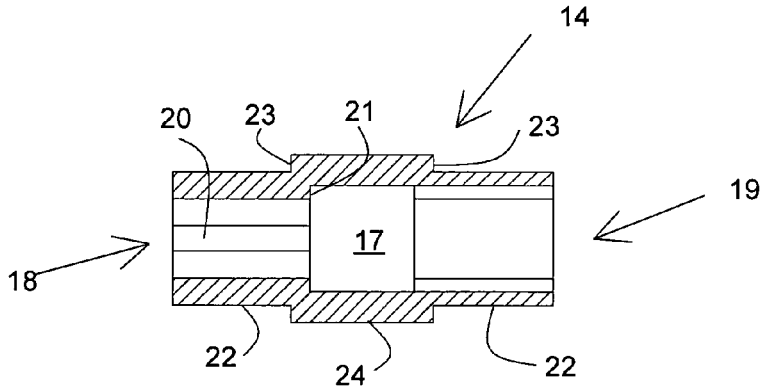
Figure 4E:
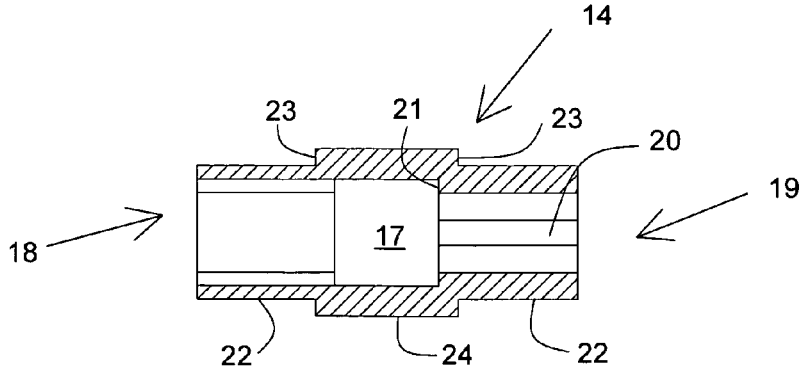
Figure 5B:
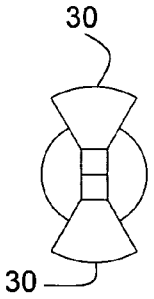
FIGS. 5 *a–d* are a side view, top view, head end view, and engaging end view of a male coupler of the present invention.
Figure 5A:
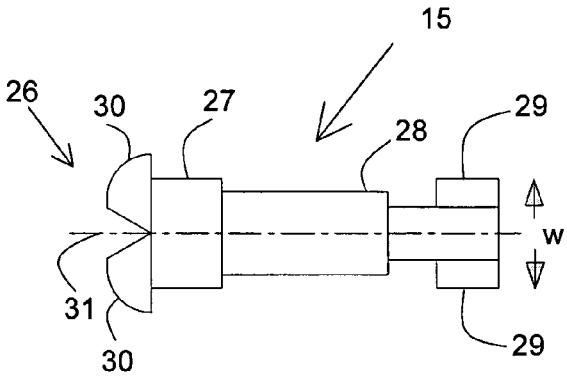
Figure 5C:
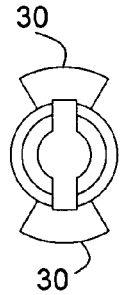
Figure 5D:
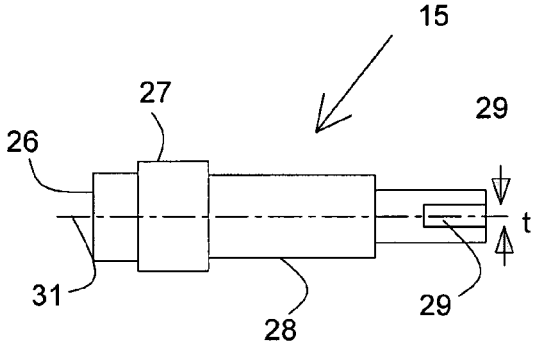
Figure 6C:
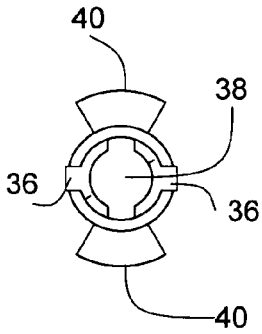
FIGS. 6 *a–d* are a side view, top view, head end view, and engaging end view of a female coupler of the present invention.
Figure 6A:
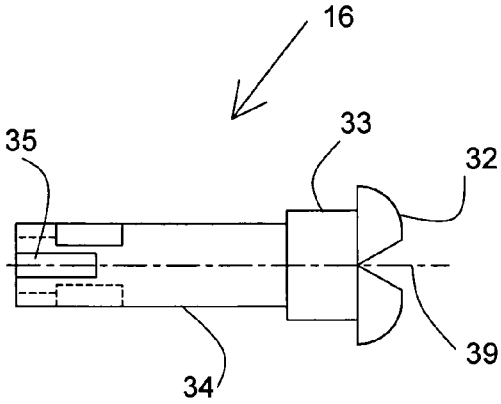
Figure 6B:
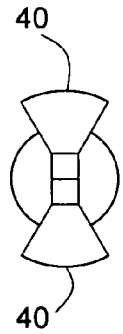
Figure 6D:
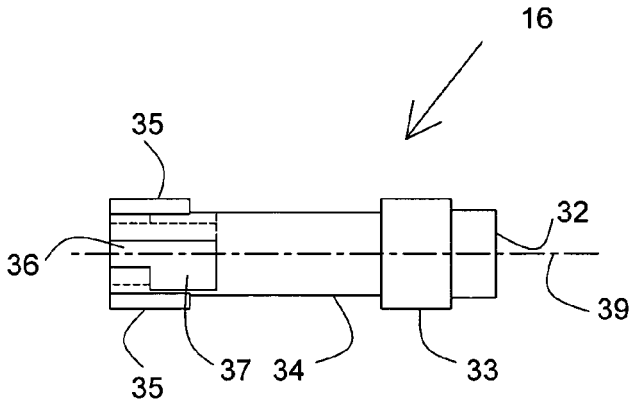

In FIGS. 4*a–e*, various views of the spacer hub 14 are shown. FIG. 4*a* is a side view, FIGS. 4*b* and 4*c* are opposing end views, and FIGS. 4*d* and 4*e* are sectional views of sections A—A and B—B (indicated in FIG. 4*b*) respectively. The various portions of the spacer hub 14 are locking chamber 17, and coupler shaft receiving cylinders 18 and 19. Each coupler shaft receiving cylinder 18 and 19 extends from an end of the coupler to the locking chamber 17. Preferably, locking chamber 17 is cylindrical in shape and each coupler shaft receiving cylinder is generally cylindrical in shape, except for opposing locking arm entry grooves 20 extending lengthwise in sidewalls of the cylinders, along the entire length of the cylinders. The diameter of each of the coupler shaft receiving cylinders 18 and 19 is preferably the same and is less than the diameter of the locking chamber 17, in order to form locking shoulders 21, the function of which is described below.

An external surface of the spacer hub 14 has bearing support surfaces 22 at each end and spacing shoulders 23 which are formed at both ends of a central portion 24 of the spacer hub. Central portion 24 has a diameter which is greater than a diameter of the bearing support surfaces 22. An inner race of each bearing 11 bears on the bearing support surface of the spacer hub when the axle assembly is in place. The spacer hub 14 has nearly a mirror image symmetry about a central plane which is parallel to the ends of the spacer hub, with the exception that the opposing locking arm entry grooves are rotated 90° about central axis 25, as best seen by comparing FIG. 4*b* with FIG. 4*c*. Because of such symmetry, the spacer hub cannot be inserted incorrectly during assembly. In assembling the axle assembly, the spacing hub is first placed through a bore in wheel 4, and then each bearing 11 is slid over the bearing support surface 22 and into bearing cavity 10. The assembled spacing hub, wheel, and bearings are then slid between the chassis sidewalls 6 and 7 (see FIG. 3) until the central axis 25 of the spacer hub is in alignment with a central axis of the aligned axle bores 8 in the chassis side walls 6 and 7.

FIGS. 5 *a–d* and 6 *a–d* show male coupler 15 and female coupler 16 of the present axle assembly. In FIGS. 5 *a–d*, male coupler 15 has head 26, chassis shoulder 27, shaft 28, and locking arms 29. Chassis shoulder 27 is dimensioned to enable it to be pressed by hand into one of the axle bores 8 of the chassis side walls 6 and 7. Head 26 limits entry of the chassis shoulder into the axle bore and also functions as a means for rotating the coupler into an engaged condition, as described below. Head 26 includes wings 30 which can be grasped between the thumb and index finger of the user to perform the engaging step. The wings have dimensions to provide adequate leverage, when rotating the coupler, but are not oversized, so as to reduce the chance of the wings contacting the skating surface during use, as discussed above. Coupler shaft 28 is dimensioned to slide freely into the coupler shaft receiving cylinder 18 or 19 of the spacer hub 14 during assembly. A clearance of about 0.001–0.004 inch is preferred between surfaces of the coupler shaft and the coupler shaft receiving cylinder. At an end of the male coupler, which is opposite the end having head 26, are disposed opposing locking arms 29. The opposing locking arms 29 extend laterally outward from the coupler and engage portions of the female coupler 16 when the axle assembly is fully assembled. The locking arms preferably are symmetric about axis 31 of the coupler. A dimension w, indicated in FIG. 5*a*, is arranged to be greater than a diameter of the coupler shaft receiving cylinders 18 and 19, but lesser than the diameter of the locking chamber 17 of the spacer hub 14. The dimension w, FIG. 5*a*, and a dimension t, FIG. 5*d* are selected to provide a sliding fit, without use of tools, into locking arm entry grooves 20. A clearance of about 0.003 to 0.008 inch between the locking arms 29 and the locking arm entry grooves 20 is preferred.

With reference to FIGS. 6*a–d*, female coupler 16 has head 32, chassis shoulder 33, shaft. 34, and locking arms 35. As in the male coupler, the head 32, chassis shoulder 33, and shaft 34 perform the same functions and are dimensioned as discussed above in describing the male coupler. Because of the near mirror image symmetry of the spacing hub 14, as discussed above, the selected end of the spacer hub, into which either the male or the female coupler is inserted, is interchangeable, so the user cannot make a mistake in that regard when assembling the axle assembly. In addition to the above-described components of the female coupler, the female coupler also includes means for interlocking with the locking arms 29 of the male coupler. Included in the interlocking means of the female coupler 16 are interlocking grooves 36 into which the locking arms 29 of the male coupler slide, and interlocking groove extensions 37 into which the locking arms 29 of the male coupler rotate when the couplers are interlocked. The interlocking grooves 36 and interlocking groove extensions 37 communicate with each other and also with interlocking cavity 38. Although only one of the interlocking grooves 36 and groove extensions 37 can be seen in FIG. 6*d*, another interlocking groove and groove extension is present on an opposing side of the female coupler. The pair of interlocking grooves and groove extensions are symmetric about a central axis 39. The communicating components of the male and female couplers are dimensioned so as to enable the locking arms 29 of the male coupler to freely enter the interlocking grooves 36 and interlocking groove extensions 37 of the female coupler during an assembly process, which is described below. The female coupler 16 also has wings 40 on head 32 for use in rotating the female coupler about its central axis 39 for interlocking the male and female couplers.

Figure 7:
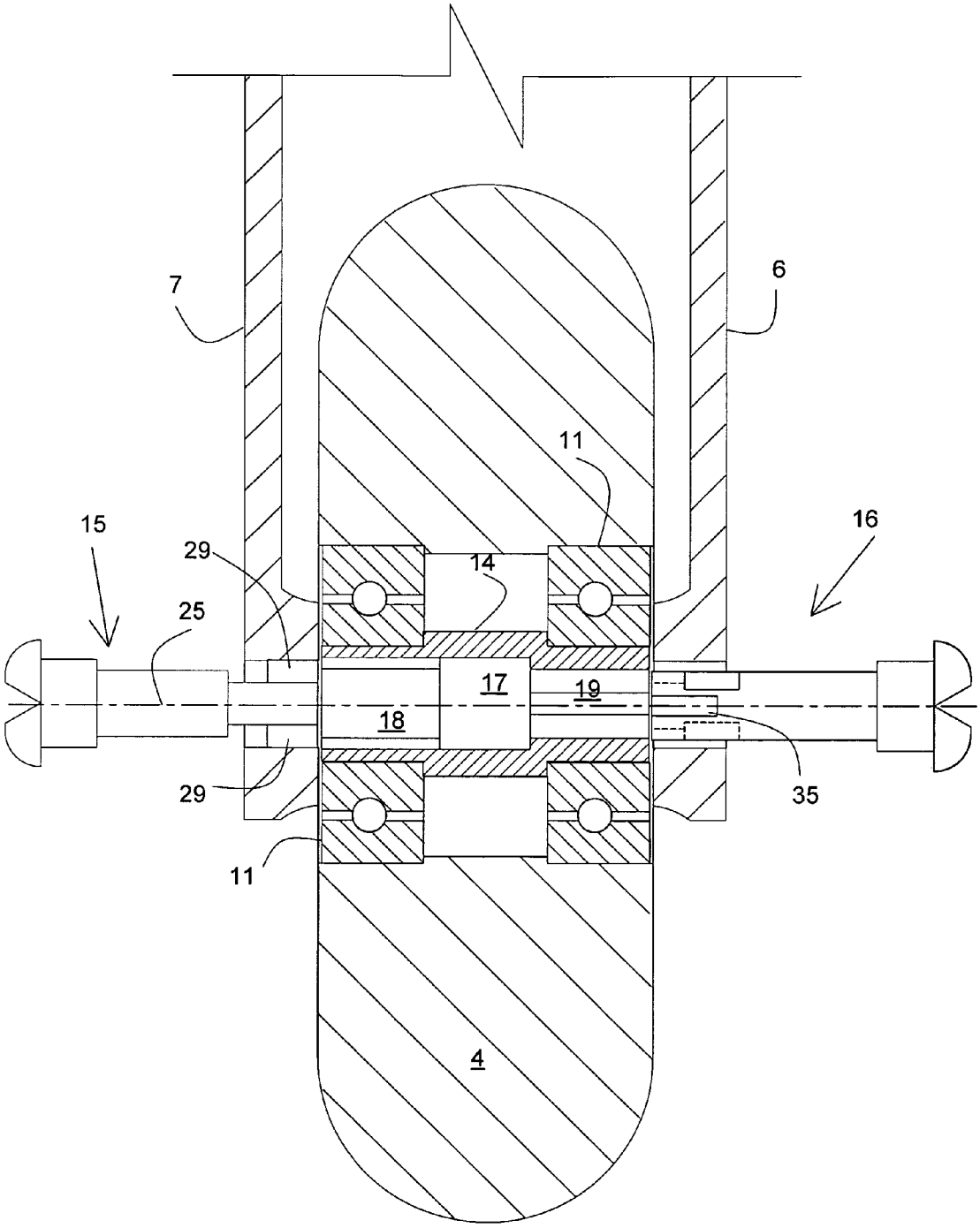
FIG. 7 is an end view of an in-line skate having an axle assembly of the present invention as arranged for initiation of an assembly process, with a chassis, a wheel, and bearings of the in-line skate shown in section.
Figure 8:
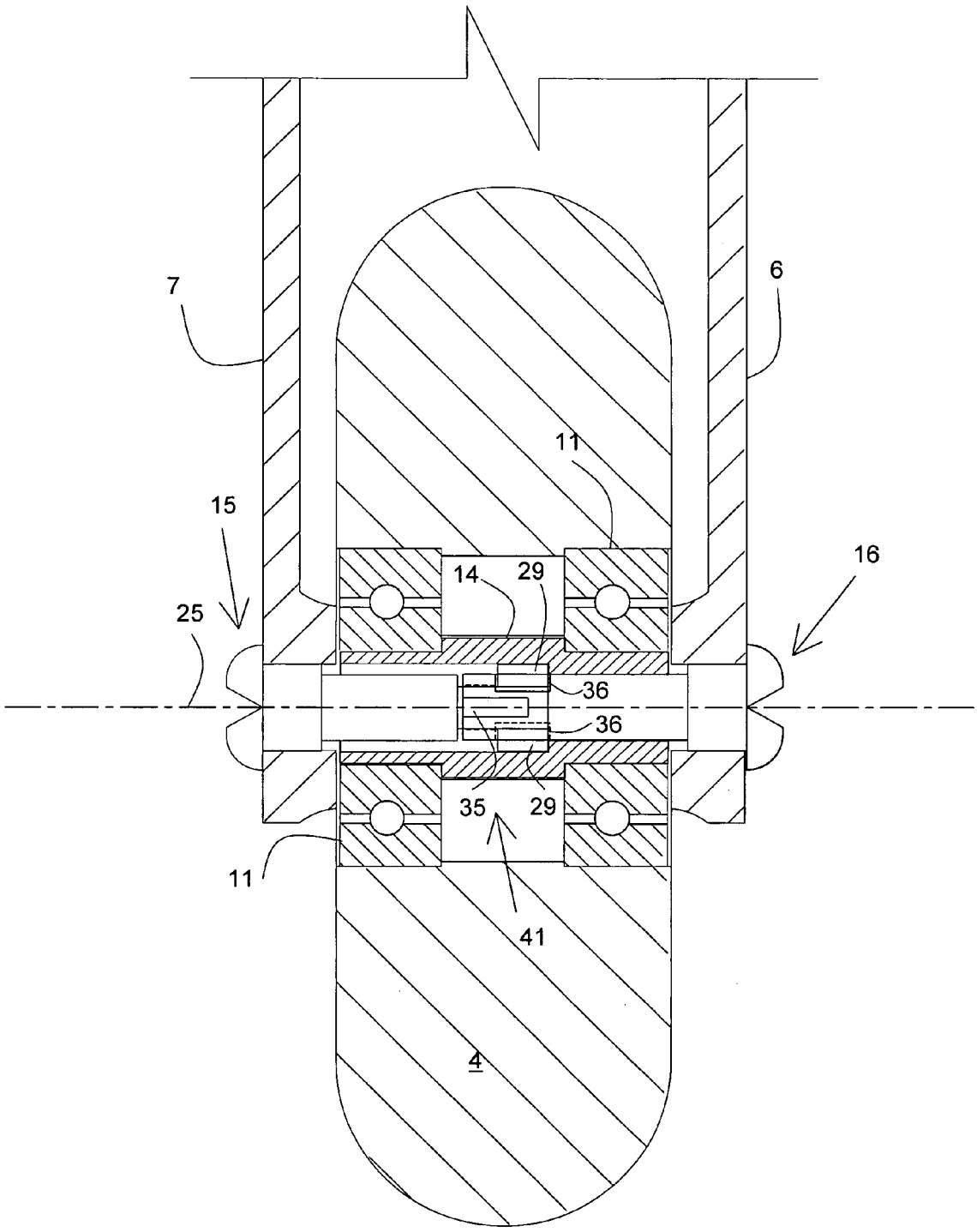
FIG. 8 is an end view of an in-line skate having an axle assembly of the present invention as arranged following a step of the assembly process for inserting the couplers, with a chassis, a wheel, and bearings of the in-line skate shown in section.
Figure 9:
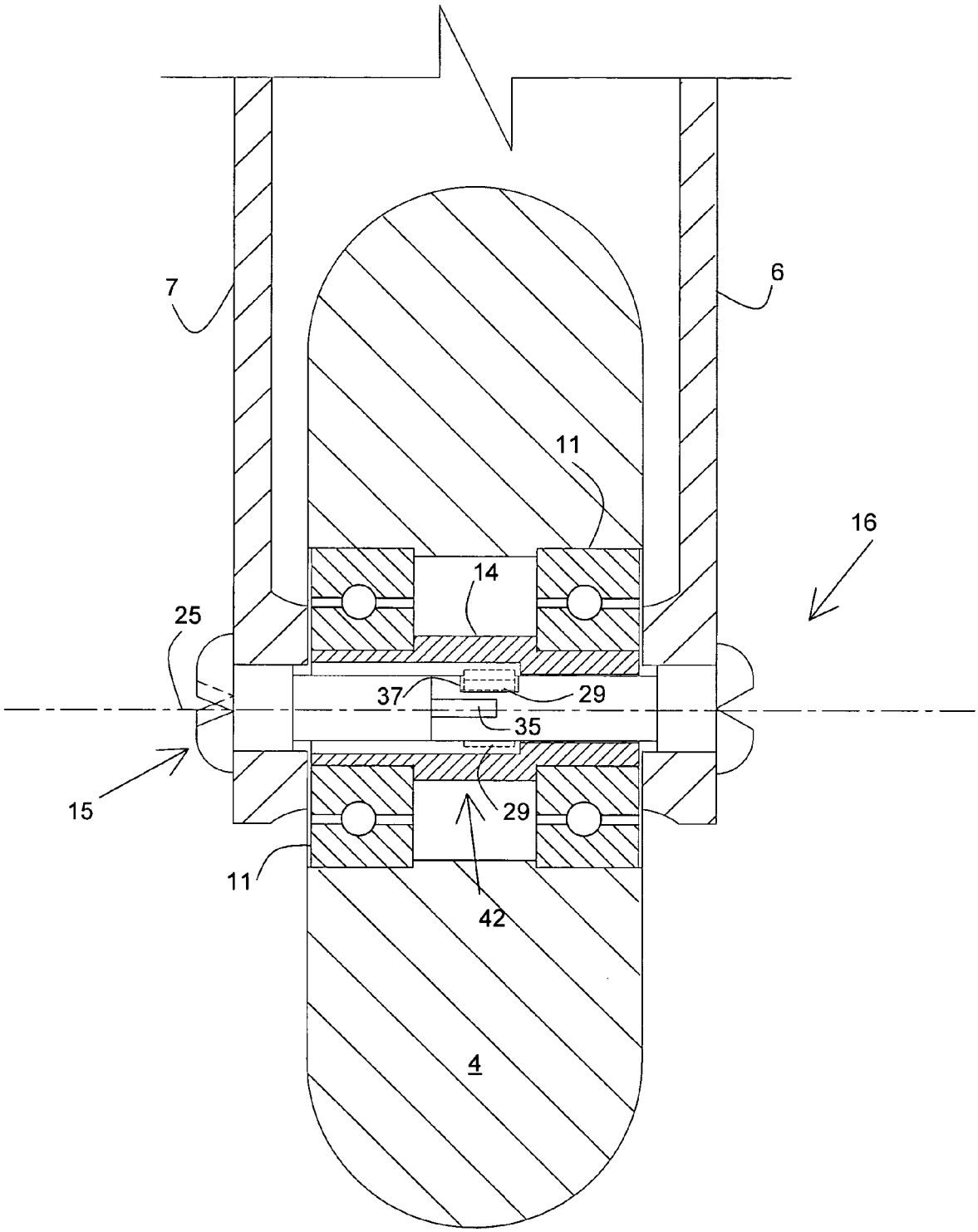
FIG. 9 is an end view of an in-line skate having an axle assembly of the present invention as arranged following a step of the assembly process for engaging the couplers, with a chassis, a wheel, and bearings of the in-line skate shown in section.

Referring to FIGS. 7, 8, and 9, the assembly process is described. FIG. 7 shows the wheel 4, bearings 11, spacer hub 14, and chassis side walls 6 and 7 in section, in a vertical plane which includes a central axis 25 of the spacer hub. As mentioned above, the wheel 4, bearings 11, and spacer hub 14 are first assembled and are then slid between the opposing chassis side walls 6 and 7, so that spacer hub axis 25 is aligned with a central axis of the aligned axle bores 8 of the sidewalls 6 and 7 of the chassis.

Following that initial step, a second step, the beginning of which is depicted in FIG. 7, is to slide the male and female couplers 15, 16 into the spacer hub 14. The procedure for the male coupler is identical to the female coupler and includes passing the coupler through the axle bore 8 and through the coupler shaft receiving cylinder 18 or 19. As mentioned above, it does not matter which coupler is inserted into a selected end of the spacer hub. During the insertion, when the locking arms reach the outer end of the spacer hub, it may be necessary to rotate the coupler about its central axis, in order to line up the locking arms with the locking arm entry grooves 20. The locking arms, locking arm entry grooves, and coupler shaft receiving cylinders are dimensioned so that the central axes of the spacing hub 14 and couplers 15 and 16 are forced into alignment when the above-described assembly step is carried out.

Following alignment of the locking arms and locking arm entry grooves, the coupler is slid all the way into the hub until the head of the coupler stops against an outside surface of the chassis side wall 6 or 7. FIG. 8 shows the axle assembly following such step, when both the male and female couplers are inserted. The locking arms 29 of the male coupler 15 are nested in the interlocking grooves 36 of the female coupler, as shown at indicator 41 of FIG. 8. Although nested, the couplers are not interlocked, at this point. During the insertion step the male and female couplers must be maintained in the rotational alignment established by the locking arm entry grooves 20 of the spacer hub 14 in order that the interlocking means are in alignment for nesting. If such rotational alignment is lost, a slight rotation of one of the couplers easily brings the components into alignment.

In a last step of the assembly process, as depicted in FIG. 9, one or both of the couplers are rotated about its central axis, so as to interlock the locking arms 29 of the male coupler in the interlocking groove extension 37 of the female coupler 16, as depicted at 42 of FIG. 9. Such interlocking prevents movement of the couplers outwardly in opposing axial directions. Thus the entire axle, bearings and wheel assembly is securely held in place.

As an added measure to more positively maintain the interlocking arrangement, the couplers can be magnetized to provide a magnetic attraction between interlocking ends of the couplers.

The components of the present invention are preferably fabricated of steel or stainless steel, however lighter weight materials such as aluminum, magnesium or titanium are possible in practice of the invention.

Fabrication of the components of the axle assembly can be carried out by machining, casting, powdered metallurgical or other fabricating methods.

While specific materials, dimensional data, etc. have been set forth for purposes of describing the invention, various modifications can be resorted to, in light of the above teachings, without departing from Applicant's novel contributions; therefore in determining the scope of the present invention, reference shall be made to the appended claims.

What is claimed is:

1. An axle assembly for an in-line skate for retaining a wheel and a pair of bearings in a chassis of the in-line skate, comprising an elongated spacer hub, for supporting a bearing at each end portion thereof;

an elongated male coupler, for bearing on a first side wall of the in-line skate chassis; and an elongated female coupler, for bearing on an opposing second side wall of the in-line skate chassis; wherein said male and female couplers are insertable inwardly through axle bores of the chassis then through opposite ends of said spacer hub to obtain an assembled condition in which the wheel and pair of bearings are retained in said chassis;

said male and female couplers are provided with means for interlocking with each other when in said assembled condition, to prevent outwardly movement of the couplers; and said elongated spacer hub is provided with support surfaces at each end for supporting said bearings, spacing shoulders for limiting insertion of said spacer hub ends into said bearings, a locking chamber, in which said coupler interlocking means are located when said axle assembly is assembled, coupler shaft receiving cylinders extending from each spacer hub end and communicating with said locking chamber, and locking arm entry grooves, extending lengthwise along sidewalls of each coupler shaft receiving cylinder, for aligning said male and female couplers during assembly.

2. The axle assembly as defined in claim 1, wherein said male coupler is insertable into either end of said elongated spacer hub and said female coupler is insertable into the remaining end.

3. The axle assembly as defined in claim 1, wherein said elongated male coupler and said elongated female coupler are provided with opposing locking arms for interacting with said locking arm entry grooves for aligning said couplers with said spacer hub.

4. The axle assembly as defined in claim 3, wherein said elongated female coupler is provided with interlocking grooves and interlocking groove extensions for interlocking with said opposing locking arms of said elongated male coupler.

5. The axle assembly as defined in claim 1, wherein said elongated male coupler and said elongated female coupler are each provided with a head for limiting the insertion of the coupler into the spacer hub, and wings for facilitating rotation of said couplers about a central longitudinal axis of each coupler, by a user during assembly.

6. The axle assembly as defined in claim 1, wherein said elongated spacer hub, said elongated male coupler, and said elongated female coupler are fabricated of a material selected from steel, stainless steel, aluminum, titanium, and magnesium.

7. An axle assembly for an in-line skate for retaining a wheel and a pair of bearings in a chassis of the in-line skate, comprising an elongated spacer hub, for supporting a bearing at each end portion thereof, an elongated male coupler, for bearing on a first side wall of the in-line skate chassis, and an elongated female coupler, for bearing on an opposing second side wall of the in-line skate chassis, wherein said elongated male and female couplers are insertable inwardly through axle bores of the chassis then through opposite ends of said spacer hub to obtain an assembled condition in which the wheel and pair of bearings are retained in said chassis by coupler interlocking means;

said spacer hub is provided with support surfaces at each end for supporting said bearings, spacing shoulders for limiting insertion of said spacer hub ends into said bearings, a locking chamber, in which said coupler interlocking means are located when said axle assembly is assembled, coupler shaft receiving cylinders extending from each spacer hub end and communicating with said locking chamber, and locking arm entry grooves, extending lengthwise along sidewalls of each coupler shaft receiving cylinder, for aligning said male and female couplers during assembly;

said elongated male and female couplers are provided with opposing locking arms for interacting with said locking arm entry grooves for aligning said couplers with said spacer hub; and said elongated female coupler is provided with interlocking grooves and interlocking groove extensions for interlocking with said opposing locking arms of said elongated male coupler when in said assembled condition, to prevent outwardly movement of the couplers.

8. An in-line skate having a skate boot, a skate chassis, and a plurality of bearings and wheels attached to said chassis by means of a plurality of axle assemblies, each axle assembly comprising, an elongated spacer hub, for supporting a bearing at each end portion thereof;

an elongated male coupler, for bearing on a first side wall of the in-line skate chassis; and an elongated female coupler, for bearing on an opposing second side wall of the in-line skate chassis; wherein said male and female couplers are insertable inwardly through axle bores of the chassis then through opposite ends of said spacer hub to obtain an assembled condition in which the wheel and pair of bearings are retained in said chassis;

said male and female couplers are provided with means for interlocking with each other when in said assembled condition, to prevent outwardly movement of the couplers;

said spacer hub is provided with support surfaces at each end for supporting said bearings, spacing shoulders for limiting insertion of said spacer hub ends into said bearings, a locking chamber, in which said coupler interlocking means are located when said axle assembly is assembled, coupler shaft receiving cylinders extending from each spacer hub end and communicating with said locking chamber, and locking arm entry grooves, extending lengthwise along sidewalls of each coupler shaft receiving cylinder, for aligning said male and female couplers during assembly;

said elongated male and female couplers are provided with opposing locking arms for interacting with said locking arm entry grooves for aligning said couplers with said spacer hub; and said elongated female coupler is provided with interlocking grooves and interlocking groove extensions for interlocking with said opposing locking arms of said elongated male coupler when in said assembled condition, to prevent outwardly movement of the couplers.

* * * * *